US005816872A

United States Patent [19]

Saito

[11] Patent Number: 5,816,872

[45] Date of Patent: Oct. 6, 1998

[54] HYDRAULIC TRIM CONTROL

[75] Inventor: Hideki Saito, Iwata, Japan

[73] Assignee: Yamaha Hatsudoki Kabushiki Kaisha, Iwata, Japan

[21] Appl. No.: 713,513

[22] Filed: Sep. 11, 1996

[30] Foreign Application Priority Data

Sep. 11, 1995 [JP] Japan ..... 7-232550

[51] Int. Cl.[6] ..... B63H 5/125

[52] U.S. Cl. ..... 440/61; 180/403; 251/30.02

[58] Field of Search ..... 440/61; 114/150; 257/30.02, 129.08; 180/403, 414

[56] References Cited

U.S. PATENT DOCUMENTS 4,605,377 8/1986 Wenstadt ..... 440/61
5,069,420 12/1991 Stobbs et al. ..... 251/30.02

*Primary Examiner*—Jesus D. Sotelo
*Attorney, Agent, or Firm*—Knobbe, Martens, Olson & Bear LLP

[57] ABSTRACT

A hydraulic tilt and trim system for a marine outboard drive wherein the tilt and trim system includes a valve body having a pair of removable check valve assemblies which form a portion of a shuttle valve. Each removable assembly carries an annular filter element for filtering the fluid pumped through the system.

24 Claims, 5 Drawing Sheets

HYDRAULIC TRIM CONTROL

BACKGROUND OF THE INVENTION

This invention relates to a hydraulic trim control for a marine outboard drive and more particularly to an improved filter arrangement for such system.

As is well known, many forms of marine outboard drives, be they outboard motors or the outboard drive portion of an inboard/outboard drive, include a hydraulic motor and pump arrangement for assisting in the trim and tilting adjustment of the outboard drive. Frequently these devices operate so as to provide both a trim adjustment and a tilt-up operation. The actual motion may be accomplished by means of one cylinder that performs both functions or a trim cylinder or cylinders that achieve the trim function and a separate cylinder that achieves primarily the tilting up operation.

Regardless of the actual hydraulic motor system employed, the systems normally include a reversible electrically-operated drive pump, a control valve arrangement and, of course, the actual fluid motor or motors. The control valve arrangement functions to control the communication between the pump and motor(s) and also the communication with the reservoir.

As with all fluid-controlled systems and particularly those employing relatively small valves, it is desirable to ensure that foreign particles do not mix with the pumped fluid and enter into the mechanism. Although it may be possible to employ filters with such arrangements, the system also should be such and the filter placement such that the filter can be easily replaced or cleaned.

It is, therefore, a principal object of this invention to provide an improved filter arrangement for a hydraulic trim control for a marine outboard drive.

It is a further object of this invention to provide an improved and simplified control valve arrangement for such apparatus wherein the filter is incorporated in the control valve so as to permit not only replacement of the filter or cleaning of the filter but also to inspect the associated valve components.

In addition to the foregoing issues, it must also be remembered that the hydraulic actuating mechanism for the tilt and trim operation must be quite compact in nature. Frequently, these units are mounted in the area between the clamping bracket and swivel bracket of the outboard drive. Such a mounting can facilitate a compact assembly and also can position the hydraulic components where they will be protected from foreign objects by the outboard drive unit itself. However, this further complicates the facility for servicing the components, and particularly for removing or servicing an oil filter.

It is, therefore, a still further object of this invention to provide an improved control arrangement for a marine outboard drive wherein a filter is employed that can be easily accessed for servicing, even though a very compact structure is provided.

SUMMARY OF THE INVENTION

This invention is adapted to be embodied in the hydraulic trim system for a marine outboard drive. The trim system is comprised of a hydraulic motor that is associated with the outboard drive for changing its position. A hydraulic pump provides a source of hydraulic fluid under pressure for the hydraulic motor. A valved conduit means is provided for selectively communicating the hydraulic pump with the hydraulic motor, and this is comprised of a valve body that defines a flow passage. A removable member is detachably connected to the valve body and communicates with the flow passage. The valve body defines a flow path, and a filter is received around the valve body in at least a portion of the flow path for filtering foreign articles from the exchanged hydraulic fluid.

DETAILED DESCRIPTION OF THE PREFERRED EMBODIMENTS OF THE INVENTION

Figure 1:
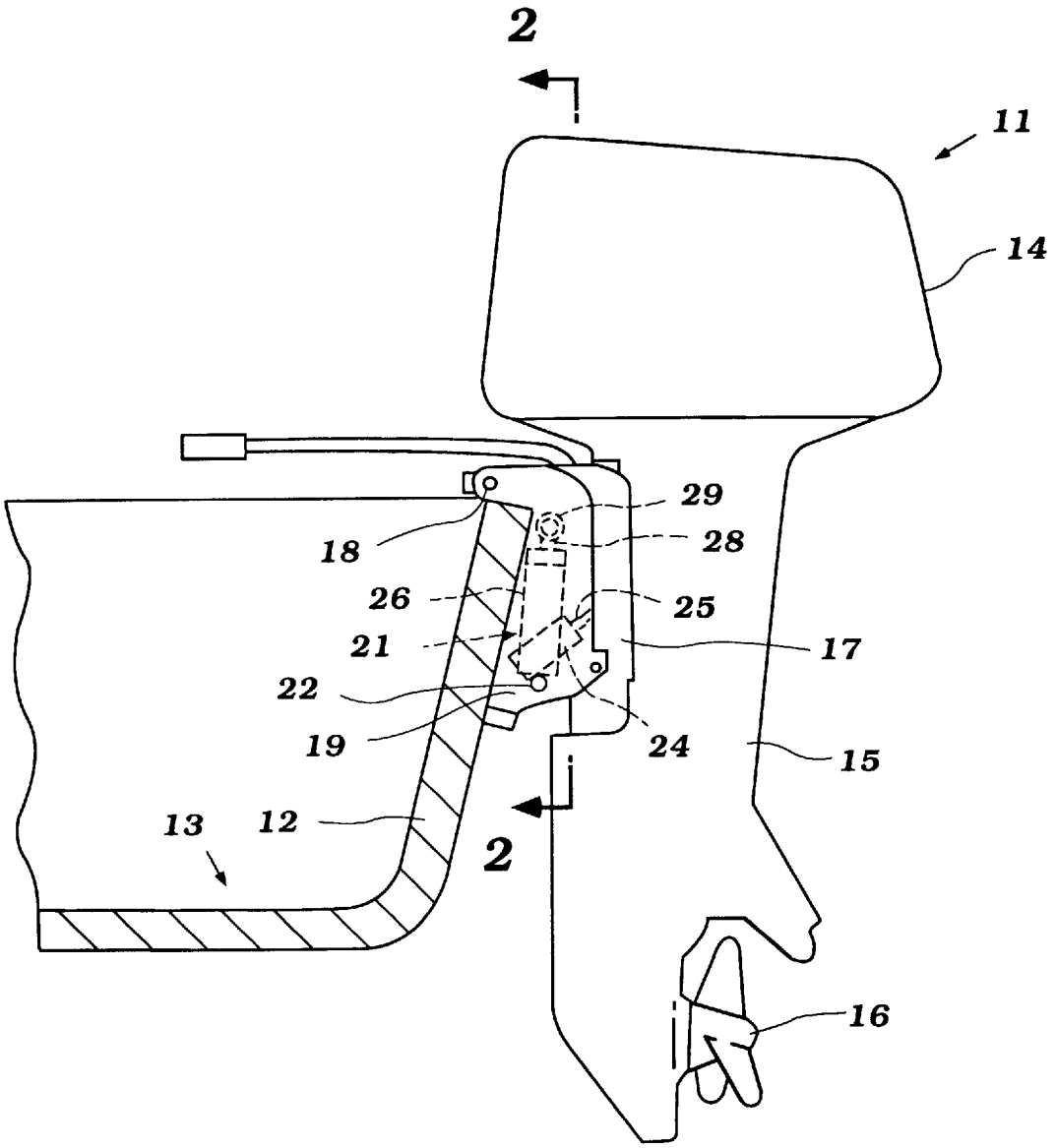
FIG. 1 is a side elevational view of an outboard motor shown attached to the transom of a watercraft, which is shown partially and in cross section.

Referring now in detail to the drawings, and initially to FIG. 1, an outboard motor is shown in side elevational view and is indicated generally by the reference numeral 11. The outboard motor 11 is depicted as being attached to a transom 12 of an associated watercraft 13, which is shown partially and in section. The invention is described in conjunction with an outboard motor, such as the outboard motor 11. It will be readily apparent, however, to those skilled in the art how the invention can be utilized with a wide variety of types of outboard drives which include not only outboard motors but also the outboard drive portion of an inboard outboard drive.

The outboard motor 11 includes a power head 14 that contains a powering internal combustion engine and a surrounding protective cowling. As is typical with outboard motor practice, the engine preferably is mounted so that its output shaft rotates about a vertically extending axis. This is done so as to facilitate coupling to a drive shaft (not shown) that extends into and is journaled within a drive shaft housing 15. The drive shaft housing 15 depends from the power head 14 and contains a transmission at its lower end via which the drive shaft drives a propulsion device such as a propeller 16 in selected forward and reverse directions.

The drive shaft housing 15 has affixed to it a steering shaft (not shown) that is journaled for steering movement within a swivel bracket 17. The swivel bracket 17 is, in turn, pivotally connected by means of a pivot pin 18 to a clamping bracket 19. This pivotal connection permits tilt and trim movement of the outboard motor 11.

A hydraulically actuated tilt and trim assembly, indicated generally by the reference numeral 15, assists in this movement. A trim pin 22 is detachably connected to the clamping bracket 19 and is engaged by the swivel bracket 17 so as to limit the maximum trimmed-down position of the outboard motor 11. The clamping bracket, which is actually comprised of a pair of side plates shown in FIG. 2 and identified by the reference numerals 19-1 and 19-2, is affixed to the transom 12 of the watercraft 13 in any well-known manner.

The construction of the outboard motor 11 and its attachment to the watercraft 13 as thus far described may be considered to be conventional. Since the invention deals primarily with the hydraulic tilt and trim mechanism 21, further description of the basic components of the outboard motor 11 are not believed to be necessary to permit those skilled in the art to practice the invention. Where any details of this construction are not shown or described, reference may be had to any prior art construction for the details.

The hydraulic tilt and trim mechanism 21 will now be described further by particular reference to FIGS. 1 and 2. This mechanism 21 is comprised of a mounting base assembly 23, which is fixed or pivotally connected between the clamping bracket side portions 19-1 and 19-2 in any suitable manner. This mounting bracket assembly 23 is associated with and forms a portion of a pair of trim cylinders, indicated generally by the reference numeral 24. These trim cylinders operate piston rods 25 that are adapted to engage the swivel bracket 17 so as to effect trim movement thereof, in a manner which will be described. Basically, the trim cylinders 24 are defined so as to provide relatively large piston areas so that high forces can be exerted with a relatively small amount of fluid pressure. As is known in this art, the hydraulic trim cylinders 24 are frequently employed to trim the outboard motor 11 up when operating in a forward drive mode.

In addition, there is provided a tilt cylinder 26 which is interposed between the clamping bracket 19 and the swivel bracket 17 so as to provide a more rapid but lower force tilt up of the outboard motor 11. This is normally done when the watercraft 13 is stationary and/or at times when the watercraft may even be out of the water, for example, while being trailered.

The tilt cylinder 26 is comprised of an outer cylinder housing having a trunion portion 27 that is connected by means of a pivot pin 18 to the mounting assembly 23. A hydraulic piston (to be described later by reference to FIG. 4) is mounted in the cylinder of the tilt cylinder 26 and has affixed to it a piston rod 28 having a trunion 29 at its upper end. A pivot pin 31 connects this trunion to the swivel bracket so as to provide a pivotal connection between the swivel bracket 17 and the piston rod 28.

Figure 2:
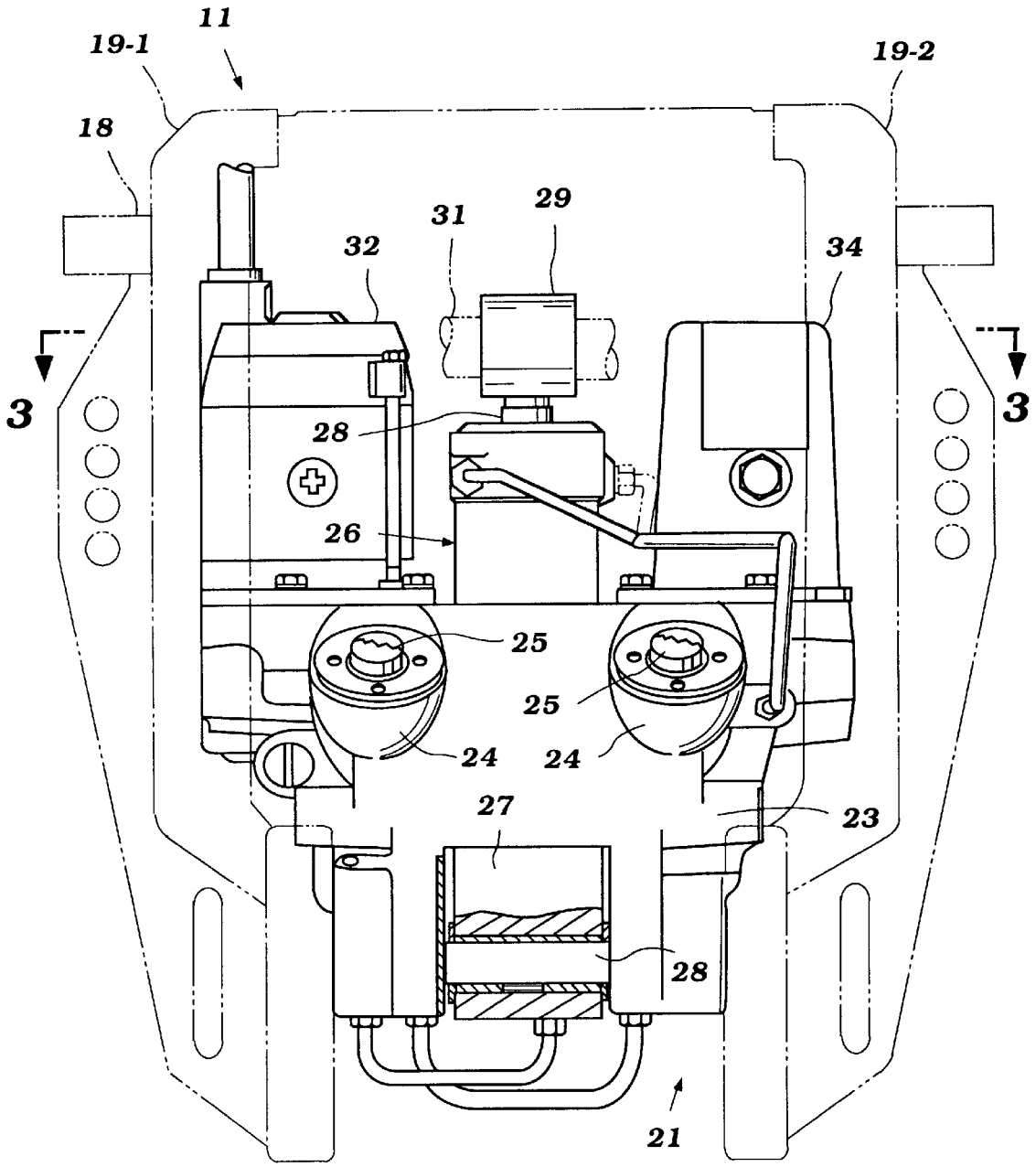
FIG. 2 is an enlarged rear elevational view showing the hydraulic tilt and trim mechanism in solid lines, with certain associated components of the outboard drive shown in phantom.
Figure 3:
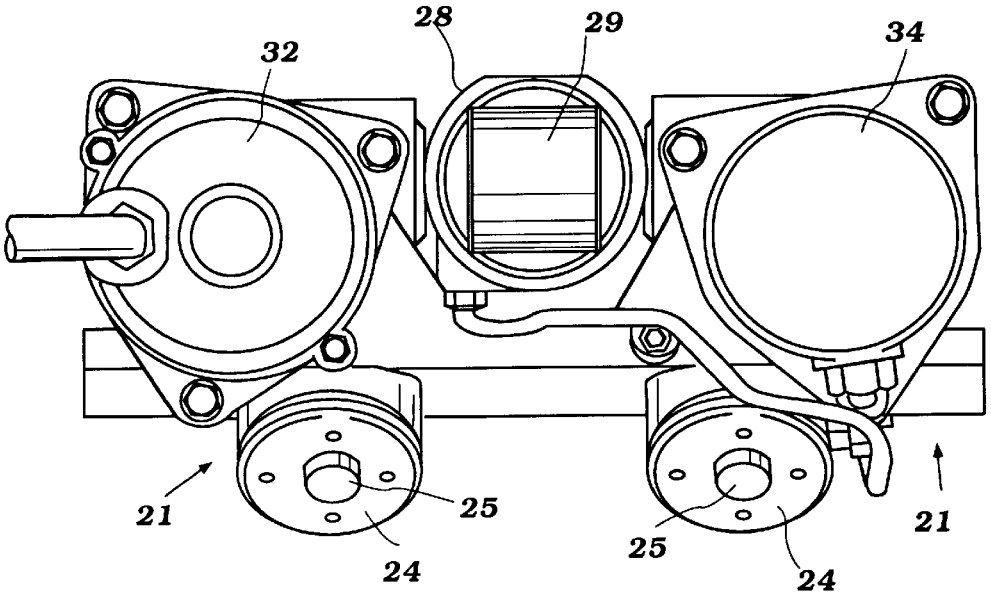
FIG. 3 is a top plan view of the hydraulic system looking generally in the direction of the line 3—3 of FIG. 2.

Also appearing in FIGS. 2 and 3 are the components which supply the hydraulic fluid to the trim cylinders 24 and tilt cylinder 26 for their operation. This system includes a reversible electric motor 32 which drives a reversible hydraulic pump, shown schematically in FIG. 4 and indicated by the reference numeral 33. Fluid is exchanged for this operation through certain conduits, as will be described. Make-up fluid is contained in a fluid reservoir 34 disposed at the opposite side of the mounting assembly 23 from the electric motor 32 and the pump 33.

Figure 4:
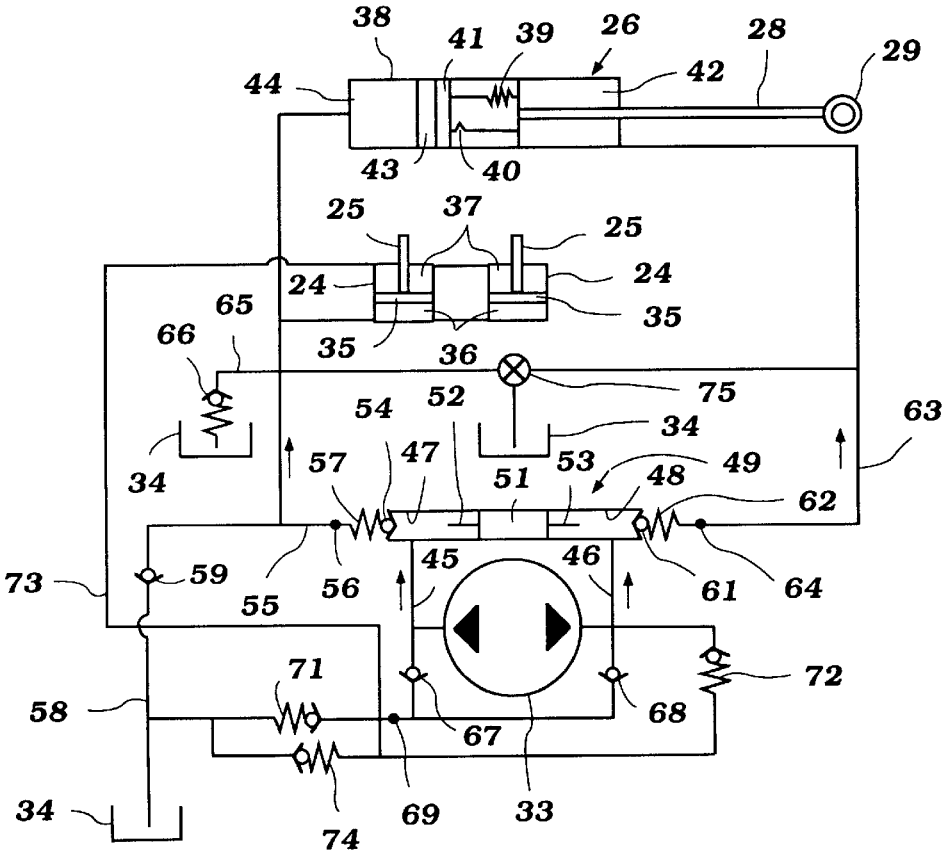
FIG. 4 is a schematic hydraulic diagram showing the tilt and trim system.

The hydraulic system will now be described by primary reference to FIG. 4, which, as has been noted, is a schematic view showing the various components, including those already described. Referring first to the trim motors 24, they are comprised of outer cylindrical housings in which pistons 35 are slidably supported. The pistons 35 divide the interior of the cylinders 24 into a lower pressure chamber 36 and an upper return chamber 37. The piston rods 25 previously referred to are integral with or connected to these pistons 35.

The tilt motor 26 includes an outer cylinder 38 in which a piston is slidably supported. The piston 50 defines first and second fluid chambers 41 and 42. The piston rod 28 extends through the chamber 42. A floating piston 43 is contained within the chamber 41 and separates it into a still further chamber 44.

To provide pop-up action when an underwater obstacle is struck, a shock absorber valve 39 is provided that permits flow through the piston from the chamber 42 to the chamber 41 when an underwater obstacle is struck. A let-down valve 40 operates to permit reverse flow when the underwater obstacle is cleared. The floating piston 43 will ensure that the trim cylinder assembly 26 returns to the previous trim-adjusted position. This type of construction is well known in the art.

Referring now to the pump assembly 33, it has been noted that this pump is reversible, being driven by the reversible electric motor 32. The pump has a pair of ports which communicate with two conduits 45 and 46. These conduits 45 and 46 are formed primarily within the housing assembly 23. These conduits 45 and 46 lead to opposite chambers 47 and 48 of a shuttle valve assembly, indicated generally by the reference numeral 49. A shuttle piston 51 separates these two chambers 47 and 48, and carries a pair of check valve actuating projections 52 and 53.

A check valve 54 normally closes the communication of the chamber 47 with a conduit 55 at a junction 56. This check valve 54 is urged by a coil compression spring 57 to its closed flow-preventing position. The conduit 55 communicates with both the chambers 36 of the trim cylinders 24 and the chamber 44 of the tilt motor 26. In addition, a make-up line 58 in which a light check valve 59 is provided communicates the return with the reservoir 34 for make-up fluid purposes, as will be described.

The conduit 46, in a similar manner, communicates with the shuttle valve chamber 48, which is normally closed by means of a check valve 61 that is held in a closed position by a coil compression spring 62. The check valve 61, when open, permits communication with a conduit 63 through a junction 64. The conduit 63 communicates with the tilt piston chamber 42.

A bypass line 65 also communicates with the conduits 55 and 63, and with the reservoir 34 through a pressure relief valve 66.

A pair of check valves 67 and 68 are disposed in a side of the conduits 45 and 46 leading from the reservoir 34 for a purpose which will also be described. A junction 69 and pressure relief valve 71 is provided in this line.

A further pressure relief valve 72 connects the conduit 46 with a conduit 73 that communicates with the return chambers 37 of the trim cylinders 24. This conduit 73 has a junction between the pressure relief valve 72 and a further pressure relief valve 74.

The tilt and trim operation will now be described by continuing reference to FIG. 4. This figure shows the system in a condition where the outboard motor is not fully trimmed down and is not totally trimmed up or tilted up to any significant extent. Thus, if trim or tilt-up operation is required, the electric motor 32 is operated so as to rotate the pump 33 so that the line 45 is pressurized. The line 46 will, therefore, function as the return line.

When the line 45 is pressurized, the shuttle piston chamber 47 will be pressurized, and the shuttle piston 51 will move to the right. Its pin projection 53 will then unseat the check valve 61 and open the communication of the tilt cylinder chamber 42 with the shuttle valve chamber 48 and the conduit 46 which, as has been noted, now acts as a return conduit.

Pressurization of the shuttle chamber 47 will cause the check valve 54 to unseat, and the line 55 is pressurized. This will cause fluid pressure to be delivered both to the trim cylinder chambers 36 and the tilt cylinder 44. Assuming the trim pistons 35 have not been fully trimmed up, they will move upwardly and effect trim up of the outboard motor 11. If there is some obstruction to flow under this condition, the relief valve 66 will open so as to relieve pressure in this conduit.

During this motion, fluid will be expelled from the trim cylinder chambers 37, through the conduit 73, back to the return side of the pump at the junction 69. If the pump requires excess flow, as it will, since less fluid is displaced from the chambers 37 and 42 than is required to operate the chambers 36 and 41 because of the respective piston rods 25 and 28, make-up fluid can be drawn through the check valve 68.

Once the trim pistons 35 move to the end of their stroke, if further up action is required, the motor 32 and pump 33 are continued to be operated until the tilt piston 39 reaches the end of its stroke. The pressure will then rise, and the relief valve 66 will open until the motor 32 is shut off.

To effect tilt-down operation, the electric motor 32 is operated so as to drive the pump 33 in a direction so that the conduit 46 is pressurized. The conduit 45 then acts as the return chamber. Pressurization of the conduit 46 causes the pressure to rise in the shuttle valve chamber 48 to urge the piston 51 to the left, and its projection 52 will open the check valve 54. The increased pressure opens the check valve 61, and the line 63 is pressurized so as to pressurize the tilt cylinder chamber 41 and lower the outboard motor.

Return fluid flows from the tilt motor 26, and specifically its chamber 44, through the line 55 and open check valve 54 to supply make-up fluid to the pump 33. If for any reason an obstruction to flow occurs, the relief valve 72 will open, and flow back to the reservoir 34 can occur through the valves 72 and 71 so as to relieve the excess pressure.

If the outboard motor 11 is lowered to the point where the swivel bracket 17 contacts the trim piston rods 25, they will be urged downwardly and expel fluid from their chambers 36 through the return path already described. During this operation it is possible for fluid to flow from the reservoir 34 to the chambers 37 of the trim cylinders 24 through the line 73.

In order to permit manual tilt-up operation, a manually operated bypass valve 75 is provided in the bypass line that includes the junction 65. Then fluid can freely flow from the tilt cylinder chambers 42 and 44 through this path. Required make-up fluid can be drawn from the reservoir 34 during this operation.

Figure 5:
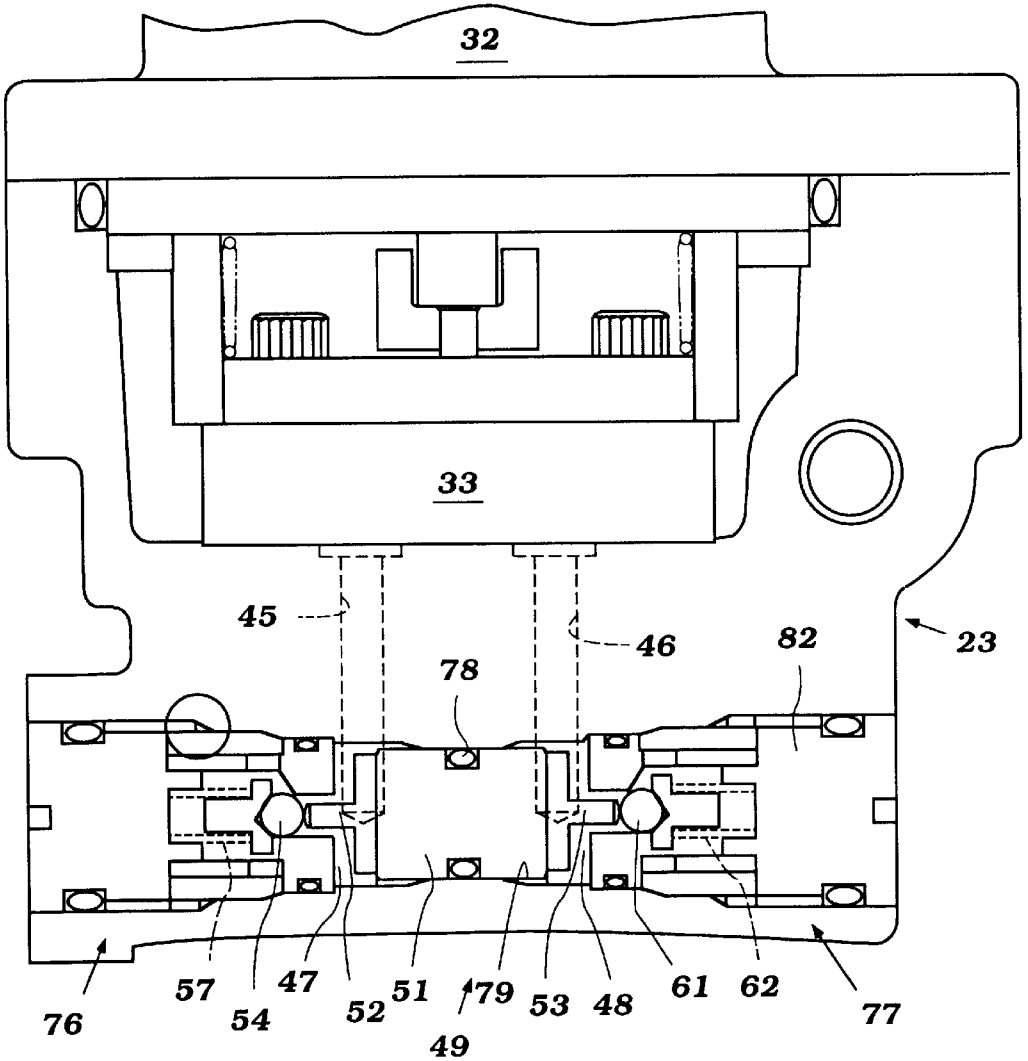
FIG. 5 is an enlarged view, with a portion broken away, showing the relationship of the hydraulic pump to the valve body, including a shuttle valve construction constructed in accordance with an embodiment of the invention.

The circuitry described is that of a basically conventionally known type, and therefore further description of it is not believed to permit those skilled in the art to practice the invention. The invention deals primarily with the construction of the shuttle valve 49, and specifically the filter arrangement associated therewith. This construction is shown best in FIGS. 5 and 6 and will now be described by reference to those figures. The reference numerals applied in describing the schematic view have been utilized where possible to indicate the same components in these figures.

Figure 6:
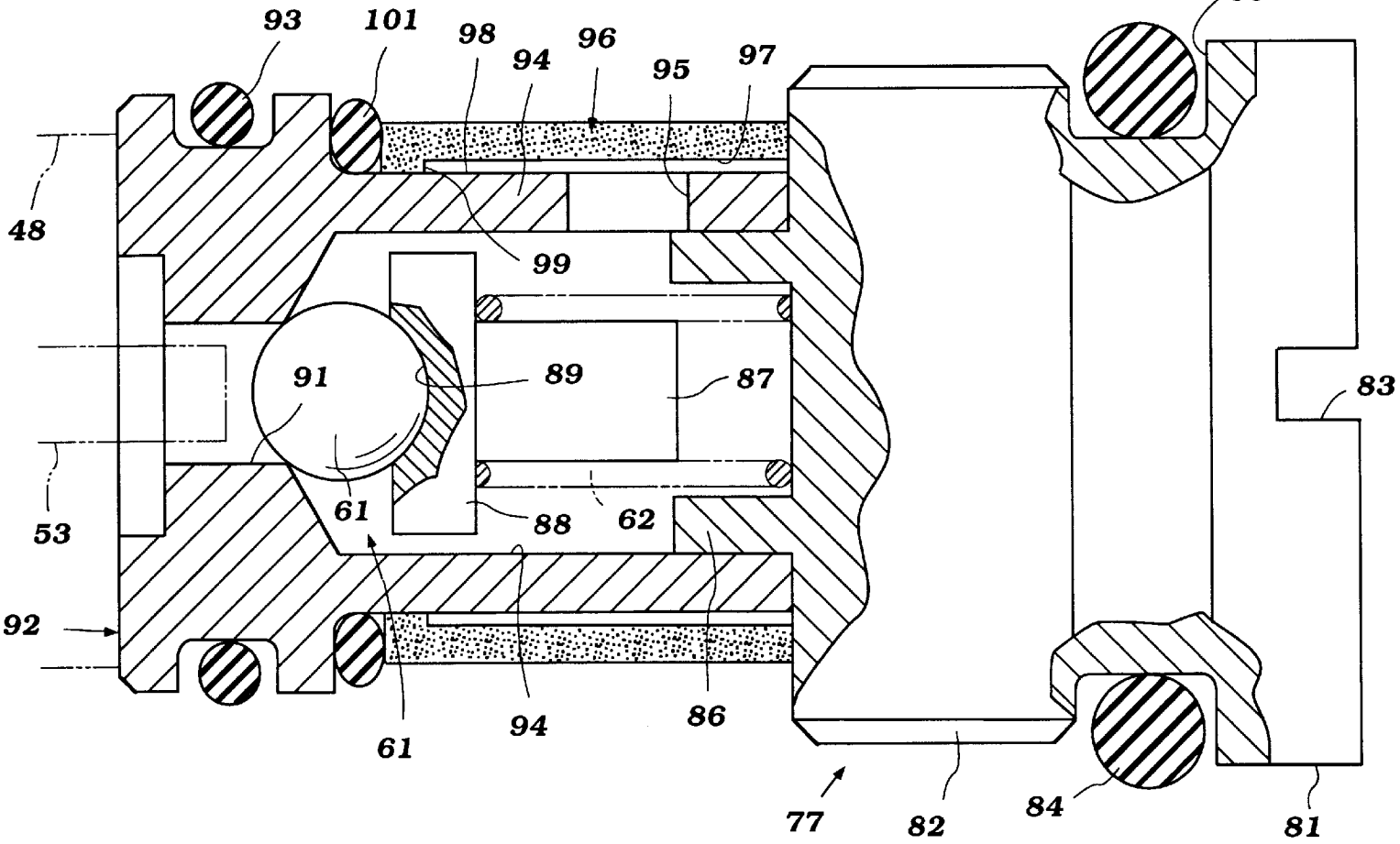
FIG. 6 is a further enlarged cross-sectional view taken through the valve body in a plane parallel to the broken-away portion of FIG. 5 and showing one end part thereof.

The check valve assemblies, including the ball-type valves 54 and 61, respectively, have been identified generally by the reference numerals 76 and 77, with the valve assembly 77 being shown in full detail in FIG. 6. First, it should be noted that the shuttle piston 51 includes an O-ring 78 that provides a seal with the shuttle valve body bore 79 that separates the chambers 47 and 48.

Each assembly 76 and 77 includes a carrier member 81 that has a threaded portion 82 that is received into a tapped opening formed on opposite sides of the housing assembly 23. A slotted head 83 of the members permits them to be threaded into place. An O-ring seal 84 is received in a groove 85 of the carrier members 81 so as to effectively seal the shuttle valve assembly 49.

The carrier members 81 have cylindrical projections 86 that receive the ends of the respective coil springs, such as the spring 62, and which encircle a cylindrical holder portion 87 having a head 88 with a groove 89 in which the ball valve 61 is contained. The ball valve 61 is cooperable with a valve seat having an opening 91, which opening is sized so as to permit the piston projection 53 to pass therethrough.

This seat member, indicated generally by the reference numeral 92, carries an O-ring seal 93 to provide a fluid-tight seal on the inner portion of the chamber 48. This member 92 has a cylindrical projection that has a further bore 94 that is slidably received over the holder projection 86 to provide a neat assembly. This projection 94 is formed with a flow port 95, which permits flow from the chamber 48 to the junction 64 through an internal passage formed in the housing member 23.

In accordance with an important feature of the invention, an annular porous metal filter, indicated generally by the reference numeral 96, is provided around this cylindrical projection 94 and spaced outwardly therefrom so that its inner surface 97 is spaced from the outer surface 98 of the projection 94. This filter has a head 99 that compresses an O-ring seal 101 against the member 92 so as to provide a fluid-tight seal which is locked in place when the member 77 is inserted into the body 23. Thus, any fluid passing through the shuttle valve assembly 49 will pass through one of the filters 96, while the outer flow will trap foreign particles. Hence, the primary filtering is provided by the inner surface 97.

When there is reverse flow through the filter 96 because of return flow, the flow in the opposite direction will tend to dislodge these particles that have been trapped and return them back to the reservoir 34. Hence, the device functions not only to filter the flow in either direction, but also has a self-cleaning action on return flow.

The assemblies 76 and 77 can be conveniently and easily removed so as to permit checking of the operation of the respective check valves 54 and 61, and also replacement of the filters 96 if required. Thus, from the foregoing description it should be readily apparent that the described system provides a very effective, easily serviced filter for the hydraulic system, which is accessible and which also will be self-cleaning. Of course, the foregoing description is that of a preferred embodiment of the invention. Various changes and modifications may be made without departing from the spirit and scope of the invention, as defined by the appended claims.

What is claimed is:

1. A hydraulic trim system for a marine outboard drive comprised of a hydraulic motor associated with said outboard drive for changing its position, a hydraulic pump for providing a source of hydraulic fluid under pressure for said hydraulic motor, valve conduit means for selectively communicating said hydraulic pump with said hydraulic motor comprised of a valve body defining a fluid passage, a removable member detachably connected to said valve body for controlling the flow through said flow passage, said removable member defining a flow path therethrough, and a fluid filter carried by said removable member for filtering the flow of fluid through said flow path.

2. A hydraulic trim system as set forth in claim 1, wherein the flow through the filter occurs in opposite directions, depending upon the direction of fluid flow between the hydraulic motor and the hydraulic pump.

3. A hydraulic trim system as set forth in claim 2, wherein the reverse flow through the filter body can pass to the reservoir for returning foreign particles to the reservoir.

4. A hydraulic trim system as set forth in claim 1, wherein the removable member has a tubular section through which the flow path therein is formed and around which the filter element extends.

5. A hydraulic trim system as set forth in claim 4, wherein the filter element comprises a cylindrical member.

6. A hydraulic trim system as set forth in claim 5, wherein the removable body has a pair of telescope sections, with the filter body being compressed between said sections.

7. A hydraulic trim system as set forth in claim 4, wherein the removable body flow path contains a check valve for controlling the flow through the flow path.

8. A hydraulic trim system as set forth in claim 7, wherein the filter element comprises a cylindrical member.

9. A hydraulic trim system as set forth in claim 8, wherein the removable body has a pair of telescope sections, with the filter body being compressed between said sections.

10. A hydraulic trim system as set forth in claim 1, wherein the fluid pump comprises a reversible fluid pump and the valve conduit means provides fluid connections between two separate fluid chambers of the fluid motor and communicates those chambers with respective ports of the fluid pump, there being comprised of a pair of removable members, each connected to the valve body and each controlling the flow in one direction between the fluid pump and the fluid motor.

11. A hydraulic trim system as set forth in claim 10, wherein a filter is carried by both of the valve bodies.

12. A hydraulic trim system as set forth in claim 11, wherein a reversible electric motor is carried by the valve body, as is the fluid pump and a fluid reservoir.

13. A hydraulic trim system as set forth in claim 12, wherein the valve body is adapted to be affixed between a pair of clamping brackets that are adapted to be affixed to a transom of an associated watercraft and which cooperate with the outboard drive.

14. A hydraulic trim system as set forth in claim 13, wherein the flow through the filter occurs in opposite directions, depending upon the direction of fluid flow between the hydraulic motor and the hydraulic pump.

15. A hydraulic trim system as set forth in claim 14, wherein the reverse flow through the filter Body can pass to the reservoir for returning foreign particles to the reservoir.

16. A hydraulic trim system as set forth in claim 13, wherein the removable member has a tubular section through which the flow path therein is formed and around which the filter element extends.

17. A hydraulic trim system as set forth in claim 16, wherein the filter element comprises a cylindrical member.

18. A hydraulic trim system as set forth in claim 17, wherein the removable body has a pair of telescope sections, with the filter body being compressed between said sections.

19. A hydraulic trim system as set forth in claim 16, wherein the removable body flow path contains a check valve for controlling the flow through the flow passage.

20. A hydraulic trim system as set forth in claim 19, wherein the filter element comprises a cylindrical member.

21. A hydraulic trim system as set forth in claim 20, wherein the removable body has a pair of telescope sections, with the filter body being compressed between said sections.

22. A hydraulic trim system for a marine outboard drive comprised of a hydraulic motor having two separate fluid chambers and associated with said outboard drive for changing its position, a reversible hydraulic pump for providing a source of hydraulic fluid under pressure for said hydraulic motor, and valved conduit means providing fluid connections between said two separate fluid chambers of said fluid motor and communicates those chambers with respective ports of said fluid pump, said valve conduit means being comprised of a valve body defining a fluid path therethrough, and a pair of removable members detachably connected to said valve body for controlling the flow through said fluid path, each controlling the flow in one direction between said fluid pump and said fluid motor, and a fluid filter carried by at least one of said removable members for filtering the flow of fluid through said fluid path.

23. A hydraulic trim system as set forth in claim 22, wherein a filter is carried by both of the removable members.

24. A hydraulic trim system as set forth in claim 23, wherein a reversible electric motor is carried by the valve body, as is the fluid pump and a fluid reservoir.

* * * * *